US005799477A

United States Patent [19]

Seibert

[11] Patent Number: 5,799,477

[45] Date of Patent: Sep. 1, 1998

[54] DEVICE FOR MAKING A WIRE STRAND WITH CHANGING TWIST DIRECTION

[75] Inventor: Gerhard Seibert, Baden, Austria

[73] Assignee: Bergsmann Ludwig, Konstanz, Germany

[21] Appl. No.: 750,685

[22] PCT Filed: Jun. 28, 1995

[86] PCT No.: PCT/AT95/00137

§ 371 Date: Mar. 17, 1997

§ 102(e) Date: Mar. 17, 1997

[87] PCT Pub. No.: WO96/00970

PCT Pub. Date: Jan. 11, 1996

[30] Foreign Application Priority Data

Jun. 28, 1994 [AT] Austria ..... A1272/94

[51] Int. Cl.[6] ..... D01H 5/00

[52] U.S. Cl. ..... 57/293; 57/99; 57/294

[58] Field of Search ..... 57/293, 294, 99, 57/359

[56] References Cited

U.S. PATENT DOCUMENTS

| | | | |
|---|---|---|---|
| 3,187,495 | 6/1965 | Christian | 57/293 |
| 3,572,024 | 3/1971 | Lyons | 57/293 |
| 4,429,519 | 2/1984 | Garner et al. | 57/294 |
| 4,493,182 | 1/1985 | Vogelsberg | 57/294 |
| 5,545,089 | 8/1996 | Kirschey | 464/83 |
| 5,606,357 | 2/1997 | Bekki | 347/104 |

FOREIGN PATENT DOCUMENTS

| | | | |
|---|---|---|---|
| 582802 | 2/1994 | European Pat. Off. . | |
| 2140697 | 2/1972 | Germany | 57/293 |
| 8030858.3 | 2/1982 | Germany . | |
| 3536488 | 4/1987 | Germany . | |

*Primary Examiner*—William Stryjewski
*Attorney, Agent, or Firm*—Henry M. Feiereisen

[57] ABSTRACT

A device for making a wire strand with changing twist direction (SZ-stranding) from individual wires, includes a fixed guide (1) provided with bores for receiving the individual wires and a plurality of spaced apart storing disks (4) capable of being driven in changing directions and also having bores for receiving the individual wires to be stranded, and a laying disk (6) capable of being driven via drive disks (7) and transmission members (9), with a drive (8) common to at least a portion of the drive disks (7) being provided, wherein between the drive (8) and the drive disks (7) there is disposed a torsionally elastic shaft (15) having an arbitrary cross-section.

8 Claims, 3 Drawing Sheets

DEVICE FOR MAKING A WIRE STRAND WITH CHANGING TWIST DIRECTION

BACKGROUND OF THE INVENTION

The invention relates to a device for making a wire strand with changing twist direction (SZ-stranding) from individual wires and in particular to a device of a type a fixed guide provided with bores for receiving the individual wires and a plurality of spaced apart storing disks capable of being driven in changing directions and also having bores for receiving the individual wires to be stranded, and a laying disk capable of being driven via drive disks and transmission members.

In known devices of this type, the laying disks are driven by the associated driving disks via mechanisms with correspondingly different speed increasing ratios. This, however, has the disadvantage that relatively large masses have to be braked within a short time and accelerated again in the opposite direction. This is especially disadvantageous for those laying disks which have a large twisting angle.

SUMMARY OF THE INVENTION

It is the object of the invention to obviate these disadvantages and to propose a device of the abovementioned type where the direction of only relatively small masses will have to be reversed.

The object of the invention is achieved by providing a drive common to at least a portion of the drive disks, wherein between the drive and the drive disks there is disposed a torsionally elastic shaft having an arbitrary cross-section. These features make it possible that at least a portion of the drive disks connected to each other via the torsionally elastic shaft does not require a separate speed increasing mechanism, since this function is provided by the torsionally elastic shaft. The decreasing twisting angles required for proper stranding which decrease in relation to the fixed guide, result from the decreasing twist of the torsionally elastic shaft in relation to its fixed end.

A preferred embodiment of the invention for wire stranding machines where large stranding forces for the items to be stranded are required, includes at least two adjacent drive disks coupled together via a rigid shaft, with the drive disks having different speed increasing ratios with respect to their associated laying disks.

The twisting action is at all possible and can be improved by maintaining the torsionally elastic shaft under tension.

Preferably, the torsionally elastic shaft is formed as a torsion spring or a torsion bar which is connected to the drive disks in a torsion-free manner. This is from an engineering standpoint, a very simple solution.

According to another feature of the present invention, the spring constant of the torsion spring and the torsion bar, respectively, increases in the direction towards the drive. In this manner, a different stiffness of the spring or rod, as the case may be, is obtained along the length of the torsion spring or the torsion bar, respectively, whereby the mass inertia of the torsionally elastic shaft can be compensated at high accelerations.

In one embodiment of a device of the invention the excursion of the filament-shaped or strip-shaped element and the lengthening caused thereby, creates a corresponding restoring force, resulting in an action similar to a torsion spring, wherein, however, the filament-shaped or strip-shaped element itself does not experience a significant torsion. If the radial distance between the bores for receiving the filament-shaped or strip-shaped element and the rotation axis of the drive disks is increased when moving in the direction from the fixed guide towards the motor, then the twisting angles of the laying disks will in turn decrease when moving from the region proximate to the motor to the region proximate to the guide.

Advantageously, the torsionally elastic shaft is formed by a cable or strip secured by a spring. In this manner, overloading of the cable can positively be prevented.

BRIEF DESCRIPTION OF THE DRAWING

The invention will now be explained in further detail with reference to the drawing, in which.

DETAILED DESCRIPTION OF THE PREFERRED EMBODIMENTS

Figure 1:
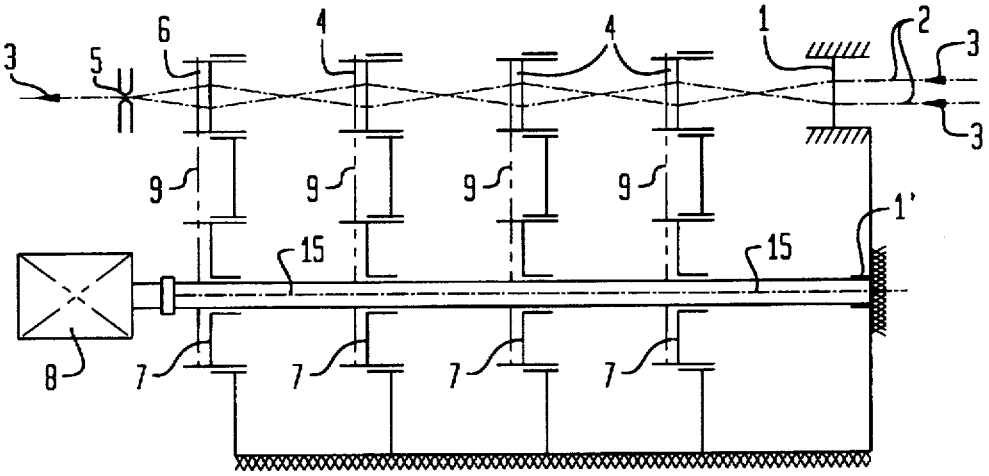
FIGS. 1 and 2 show schematically two different embodiments of devices according to the invention.
Figure 2:
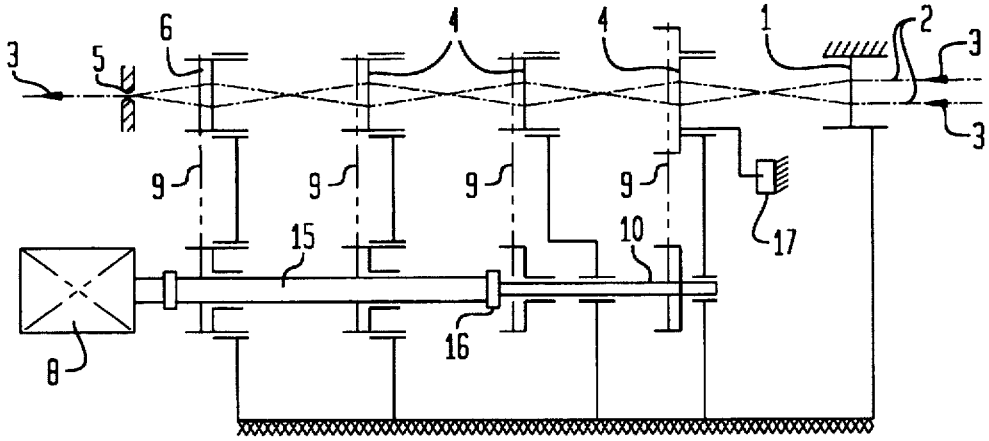

In the embodiments according to FIGS. 1 and 2, there is provided a fixed guide 1 provided with bores arranged concentrically with respect to a center axis for receiving individual wires 2.

Subsequent to the fixed guide 1 there are arranged essentially equally spaced storing disks 4 along the pulling direction of the individual wires 2 which is indicated by arrows 3, wherein the storing disks 4 are also provided with bores arranged concentrically with respect to a rotation axis of the string disks 4 for receiving individual wires 2. In this case, the storing disks 4 and a laying disk 6 are capable of being driven in changing directions.

A cable guide 5 is provided following the laying disk 6 through which the cable is withdrawn.

The storing disks 4 and the laying disk 6 are each driven via a transmission member 9, such as a belt, by the drive disks 7 which are coupled to a motor 8.

In both embodiments, a torsion spring 15 is provided as a coupling element which in the embodiment of FIG. 1 is secured to a part of the frame in the area of a fixed guide 1'.

In the embodiment of FIG. 2, the torsion spring 15 is provided only for a portion of the storing disks 4, i.e. coupled to the two laying disks closest to the motor 8.

In both embodiments, the drive disks 7 are coupled to the storing disks 4 and the laying disk 6, respectively, via the belt 9. In this case, for all of the drive disks 7 coupled to the torsion spring 15 the same speed increasing ratio may be provided with respect to the associated storing disks 4 and laying disk 6, respectively.

In the embodiment of FIG. 2, the two drive disks 7 closest to the fixed guide 1 are coupled together via a rigid shaft 10 which is in turn coupled at 16 to the torsion spring 15. In contrast to the speed increasing ratio of the two drive disks 7 closest to the motor 8, however, the speed increasing ratios for these drive disks with respect to their associated storing disks 4 may be different.

At the rotatably supported end of the rigid shaft 10 facing away from the coupling 16, a limit stop is provided for limiting the twisting angle of the storing disk 4 at that respective position, the positions of the limit stop being arranged in such a way that the respective storing disk 4 is capable of rotating in both SZ-directions by the corresponding rotation angle.

The difference of the twisting angles between the storing disk 4 which is closest to the fixed guide 1 and is still or is already driven by the spring, and the laying disk 6 has to be equal or larger than the twisting angle required by the laying disk for acceleration. In this way, the motor can be rapidly brought to its nominal speed and the reversing region from left to right or vice versa on the stranded item can be kept short.

Figure 3:
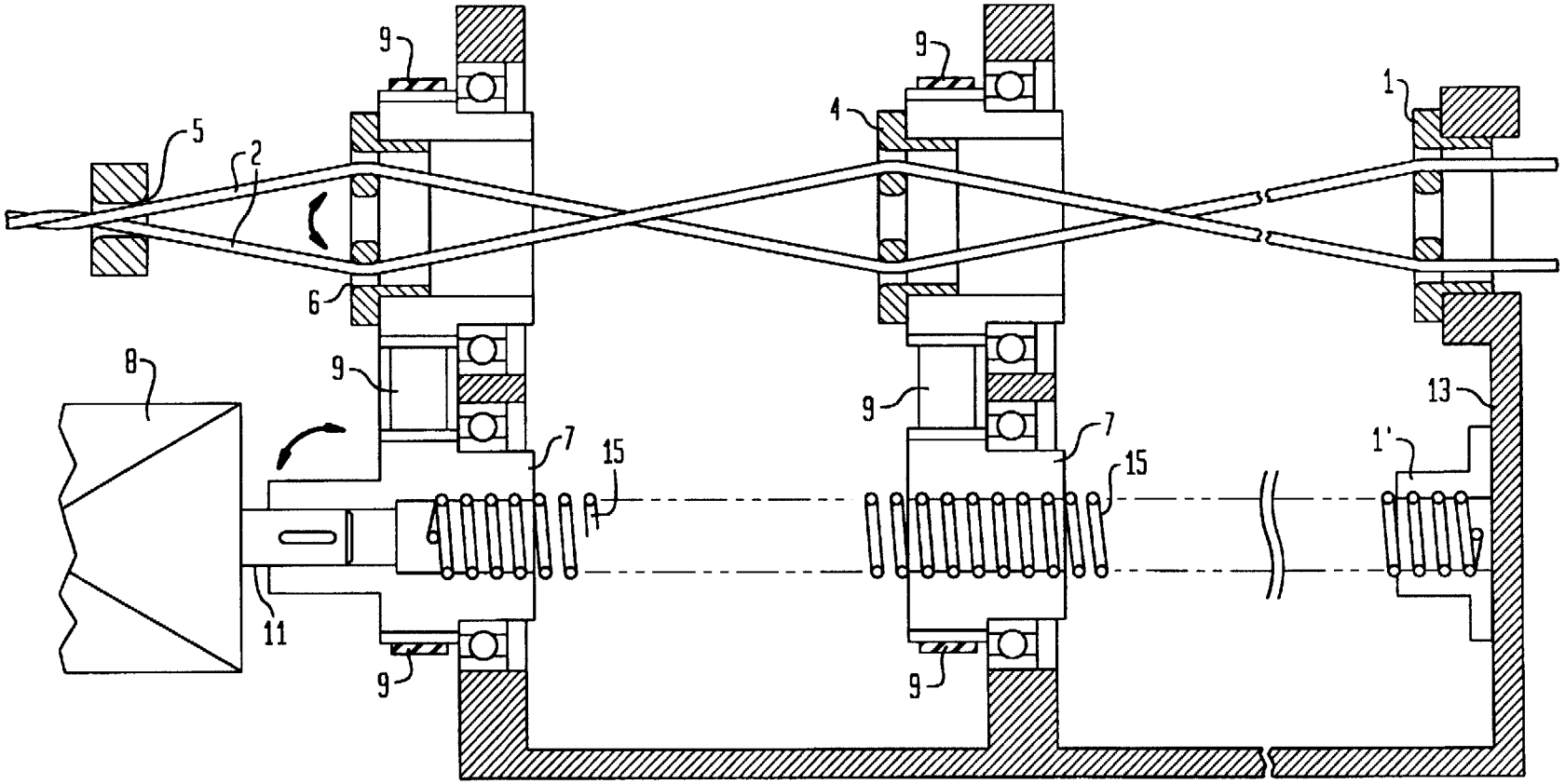
FIG. 3 shows a schematic, sectional view of a device according to the invention.

FIG. 3 shows that the motor 8 and its shaft 11, respectively, are coupled in a torsion-free manner to the drive disk 7 which, in turn, is coupled in a torsion-free manner to the torsion spring 15. The drive disk 7 associated with the storing disk 4 closest to the motor 8 is also coupled in a torsion-free manner to the torsion spring 15, with the torsion spring 15 fixedly secured in a support 1 which is in turn supported by a frame portion 13 of the device.

Figure 4:
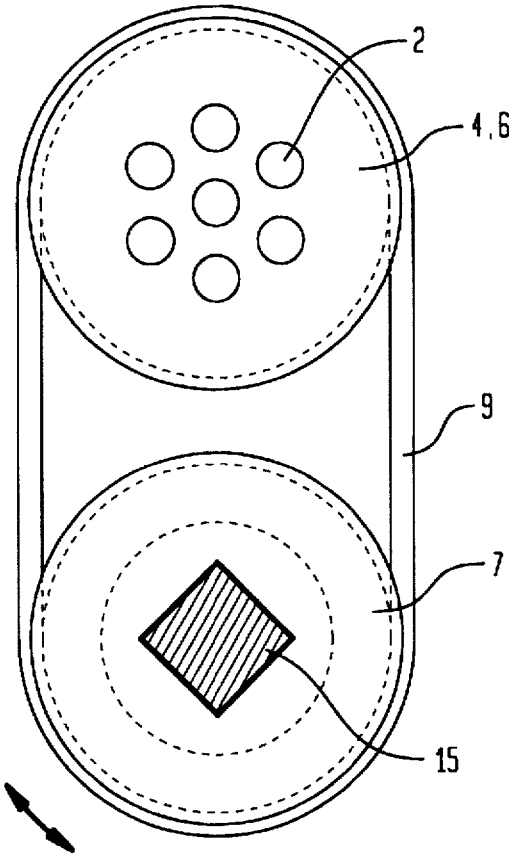
FIGS. 4 and 5 show further embodiments of the invention.

In the embodiment of FIG. 4, the torsion spring 15 is replaced by a torsion bar 15 which provides an identical effect and function as if a torsion spring 15 was used.

Figure 5:
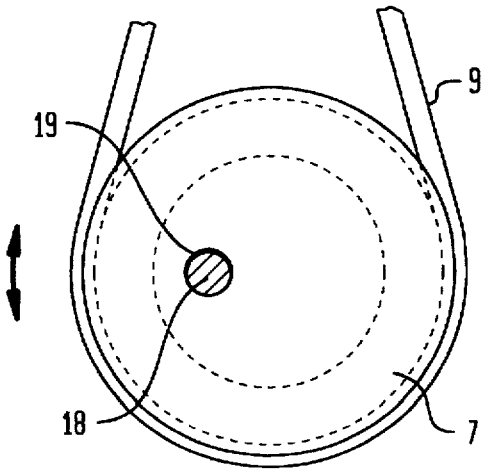

FIG. 5 shows an embodiment where the torsionally elastic shaft is formed by at least one taught, extendible filament-shaped or strip-shaped element 18 which is guided through eccentrically arranged bores 19 of the drive disks 7 and secured to the drive disk 7 closest to the motor 8, wherein the eccentricity of the bores in the drive disks 6 which are penetrated by the filament-shaped element, may increase in the direction towards the motor 8. The cable or strip 18 is preferably secured by a spring which is not shown. Alternatively or in addition, the cable may also comprise an elastically extendible material, such as rubber, plastic or the like, and may not be prestressed.

What is claimed is:

1. A device for making a wire strand with changing twist direction (SZ-stranding) from individual wires, comprising:

a fixed guide provided with bores for passage of individual wires;

a plurality of storing disks trailing the fixed guide and arranged in spaced-apart disposition, said storing disks having bores for passage of the individual wires to be stranded;

a laying disk trailing the plurality of storing disks; and drive means for operating the storage disks and the laying disk in changing directions, said drive means including a plurality of drive disks and a like plurality of transmission members, said drive disks and said transmission members being so positioned that each of the storage disks and the laying disk are operatively connected to a different one of the drive disks via a different one of the intermediate transmission members, said drive means further including a motor operatively connected to at least some of the drive disks, and a torsionally elastic shaft having a random cross-section and extending between the motor and the drive disks.

2. The device of claim 1, and further comprising a rigid shaft for coupling at least two neighboring drive disks, with said neighboring drive disks and the associated storage disks having different transmission ratios.

3. The device of claim 1 wherein the torsionally elastic shaft is maintained under tension.

4. The device of claim 1 wherein the torsionally elastic shaft is formed as an element selected from the group consisting of torsion spring and torsion bar, and connected to the drive disks in a torsion-free manner.

5. The device of claim 4 wherein the torsionally elastic shaft has a spring constant increasing in the direction towards the motor.

6. The device of claim 1 wherein the torsionally elastic shaft is formed by at least one tensed, extendible filament-shaped or strip-shaped element which is guided through eccentrically arranged bores of the drive disks and secured to the drive disk closest to the motor.

7. The device of claim 6 wherein the eccentricity of the bores in the drive disks increases in the direction towards the motor.

8. The device of claim 1 wherein the torsionally elastic shaft is formed by a cable or strip secured by a spring.

* * * * *